US008530842B2

(12) United States Patent
Has et al.

(10) Patent No.: US 8,530,842 B2
(45) Date of Patent: Sep. 10, 2013

(54) COOKING HOB DEVICE

(75) Inventors: Uwe Has, Unterneukirchen (DE); Peter Vetterl, Traunstein (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 233 days.

(21) Appl. No.: 13/057,536

(22) PCT Filed: Aug. 4, 2009

(86) PCT No.: PCT/EP2009/060113
§ 371 (c)(1),
(2), (4) Date: Feb. 4, 2011

(87) PCT Pub. No.: WO2010/020541
PCT Pub. Date: Feb. 25, 2010

(65) Prior Publication Data

US 2011/0134413 A1 Jun. 9, 2011

(30) Foreign Application Priority Data

Aug. 20, 2008 (DE) ..... 10 2008 041 390

(51) Int. Cl.
*G01J 5/12* (2006.01)
*G01J 5/18* (2006.01)

(52) U.S. Cl.
USPC ..... 250/339.04; 250/338.1

(58) Field of Classification Search
USPC ..... 250/338.1, 339.01, 339.02, 339.04, 250/339.11, 339.14, 339.15
See application file for complete search history.

(56) References Cited

U.S. PATENT DOCUMENTS

| | | | | |
|---|---|---|---|---|
| 5,196,830 | A | 3/1993 | Birging et al. | |
| 6,111,228 | A * | 8/2000 | Berkcan et al. | 219/446.1 |
| 6,169,486 | B1 * | 1/2001 | Berkcan et al. | 340/584 |
| 2004/0162871 | A1 | 8/2004 | Pabla et al. | |
| 2004/0236850 | A1 | 11/2004 | Krumm et al. | |
| 2005/0061958 | A1 * | 3/2005 | Baier | 250/221 |
| 2006/0268896 | A1 | 11/2006 | Kotola et al. | |
| 2009/0303926 | A1 | 12/2009 | Hartog et al. | |
| 2010/0297928 | A1 | 11/2010 | So | |

FOREIGN PATENT DOCUMENTS

| | | | |
|---|---|---|---|
| DE | 10015745 | A1 | 10/2001 |
| DE | 10337538 | A1 | 2/2005 |
| EP | 1505350 | A2 * | 2/2005 |
| WO | WO03074940 | A1 | 9/2003 |
| WO | WO2007085592 | A1 | 8/2007 |
| WO | WO2008024099 | A2 | 2/2008 |

OTHER PUBLICATIONS

Litwiller, Dave, "CCD vs. CMOS: Facts and Fiction", Photonics Spectra, Jan. 2001 Issue, Laurin Publishing Co. Inc. (Reprint).*

* cited by examiner

*Primary Examiner* — Mark R Gaworecki
(74) *Attorney, Agent, or Firm* — James E. Howard; Andre Pallapies

(57) ABSTRACT

A hob device is provided that has a monitoring unit to monitor a cooking area of a hob. The monitoring unit includes a sensor array of multiple infrared sensors to record infrared light.

21 Claims, 5 Drawing Sheets

COOKING HOB DEVICE

BACKGROUND OF THE INVENTION

The invention is based on a hob device, as well as on a method for a hob.

A hob device with a monitoring unit which monitors a control panel and a cooking area in a hob, is known from DE 103 37 538 A1. This monitoring unit has an optical sensor unit which is constructed as an infrared camera.

BRIEF SUMMARY OF THE INVENTION

The object of the invention consists in particular in providing a generic device with improved characteristics with regard to production costs and compact design.

The invention is based on a hob device with a monitoring unit for monitoring at least one cooking area of a hob which has at least one sensor unit provided to record in the infrared region.

It is proposed that the sensor unit has a plurality of infrared sensors that are arranged in a sensor array. This enables a space-saving hob device to be provided at low production costs. In particular, in comparison with a conventional solution with an infrared camera, a compact and low-cost monitoring unit can be created for a hob by an arrangement of compact and economical infrared sensors in a sensor array. A particularly economical design of the monitoring unit can be achieved if the infrared sensors forming the sensor array have thermocouples. A thermocouple is understood to be in particular an element that produces an electrical potential based on a temperature difference. Compared to sensor elements of an infrared optical system, a sensor unit based on the use of thermocouples is more economical to produce and requires less space. In a particularly advantageous way, the infrared sensors can be constructed as thermopiles or thermocouple piles.

A "cooking area" is understood to be, in particular, an area of a hob that is provided for an arrangement of food to be cooked for a cooking process with the food to be cooked. This area preferably corresponds to a three-dimensional area that extends above a hotplate of the hob and is delimited from below by the surface of the hotplate. "Infrared range" is understood to be in particular a wavelength range that includes at least one portion in the range from 780 nm to 1 mm. In this connection each of the infrared sensors advantageously has at least one sensitivity range in a wavelength range that is matched to the temperatures which typically occur in a hob application. By "infrared sensor" is meant in particular a sensor with at least one sensitivity range in the infrared range. By a "sensor array" is meant in particular an arrangement of sensors that is arranged on a common support, for example a level support. Preferably, the support and the sensor array are located in a common sensor housing. Advantageously, immediately adjacent sensors of a sensor array are spaced at a constant distance from one another over the sensor array. "Provided" is understood to be, in particular, specially configured, constructed and/or programmed.

A particularly advantageous application of an arrangement of infrared sensors in a sensor array consists in acquiring an image of the monitored cooking area, it being possible for an image of the cooking area to be obtained by the proposed sensor array of infrared sensors, economically and by a simple construction. In this connection, in a preferred embodiment of the invention it is proposed that the hob device has an evaluation unit that is provided for image evaluation of data recorded by the sensor unit. "Image evaluation of data recorded by the sensor unit" means, in particular, data evaluation that is designed to generate an image of the cooking area recorded in the field of vision of the sensor unit. Due to image evaluation, geometrical data of an object in particular can be obtained from the data detected and displayed by means of the data of the sensor unit. In particular, information about the dimensions and/or the contour of objects, which can be displayed by means of the data, can be determined by means of the data from the sensor unit. For this, the evaluation unit is provided in particular with a program or with image processing software.

It is proposed in particular that in order to detect an application situation during operation of the hob, the evaluation unit and the sensor unit are provided to act in combination to record and evaluate a chronological sequence of images of the cooking area, thereby enabling a high density of data to be obtained. In this connection, an "image" means in particular a data set that is acquired by the sensor unit and is suitable for generating an image of the monitored cooking area. An evaluation of an image by the evaluation unit can correspond to an evaluation of the data set, without the image having to be displayed by means of a display device.

It is also proposed that the evaluation unit be provided to assign an application situation from a change of a contour determined in at least two different images, which enables particularly simple and rapid detection of an application situation. By "contour" in particular is meant an external boundary of an object which can be displayed by means of data from the sensor unit. The contour can be determined by means of the evaluation unit with the aid of the sensor unit data, such as in particular by means of a pre-programmed contour extraction algorithm. A "change" in the contour can mean in particular an enlargement or a reduction whilst retaining a specific geometrical shape and/or a change in the geometrical shape. In this connection, for rapid recognition of an application situation, geometric patterns can be pre-stored in a memory unit of the evaluation unit, it being possible for a determined contour to be compared with a pre-stored pattern.

Particularly precise monitoring of the cooking area can be achieved if the arrangement of infrared sensors in the sensor array effects a rasterization of the cooking area to be monitored and if at least eight grids, in particular at least sixteen grids, are assigned to one direction of extension of the cooking area to be monitored. The direction of extension can be in particular one length or one width of the cooking area.

The sensor array can be one-dimensional, for example, it being possible for it to correspond to an in-line arrangement of infrared sensors in which the infrared sensors follow each other in one direction. However, it is particularly advantageous if the sensor array is a two-dimensional one. As a result, a larger part of the cooking area, in particular the entire cooking area of the hob, can be detected by the sensor unit. A "two-dimensional array" is understood to be in particular an arrangement in which an unambiguous pair comprising a column number and a row number can be assigned to every element of the arrangement, it being possible for the column numbers and the row numbers to assume at least two values in each case.

In this connection, a regular rasterization of the monitored cooking area can be achieved if the sensor array is a square matrix arrangement.

It is proposed in a further embodiment of the invention that the sensor unit has a field of vision that extends into a location area for a user of the hob during operation of the hob, whereby advantageously the monitoring unit can check to see whether a continuous cooking process is being carried out under the supervision of the user of the hob. In particular, the field of vision is determined by an optical system upstream of the sensitivity range of the sensor unit and/or by the arrangement of the sensor unit relative to the cooking area.

In an advantageous embodiment of the invention, the monitoring unit is designed as a safety device for detecting a hazardous situation during operation of the hob.

In this connection, a high level of safety can be achieved if the monitoring unit has an evaluation unit which is provided to differentiate between normal heating of food to be cooked and an at least potentially unintentional application situation. Differentiation between "normal" heating and an at least potentially unintentional application situation takes place for example by means of a comparison of recorded data from the sensor unit and/or an evaluation result of the evaluation unit, with pre-stored data. For this, the evaluation unit advantageously has a memory unit in which criteria which characterize an application situation as a normal application situation, a potentially unintentional application situation or an unintentional application situation, are stored. For example, a criterion can correspond to a temperature value or the shape of a geometrical contour. An "unintentional" application situation means an application situation for which action to remove imminent danger must be taken without delay, in particular immediately. A "potentially unintentional" application situation is an application situation in which the intention of the user of the hob cannot be ruled out. In this case where such an application situation exists, the user of the hob is requested to confirm his intention to implement a cooking process with specific heating parameters.

In a particularly advantageous embodiment of the invention it is proposed that the evaluation unit be designed to detect the presence of food to be cooked that is outside a cooking vessel provided to heat it up. This can be achieved in a particularly simple manner by monitoring a contour obtained by means of data from the sensor unit.

Furthermore, it is proposed that the hob device has a control unit for controlling a heating operation in at least two cooking zones of the cooking area, which in cooperation with the evaluation unit is provided to alter the heating operation of at least one of the cooking zones according to the position of the unintentional heating in the monitored cooking area when unintentional heating is detected in the cooking area. Alternately, or additionally, the control unit can be designed to switch off all current heating operations of the hob when an unintentional application situation is detected in a cooking zone.

Furthermore, the invention is based on a method with a hob in which a cooking area of the hob is monitored by means of a monitoring unit. It is proposed that data from infrared sensors arranged in a sensor array are captured and are evaluated for detection of an application situation. As a result, economical and space-saving elements can be used for a monitoring process.

Particularly reliable detection of an application situation can also be achieved if the data are evaluated by means of image evaluation.

BRIEF DESCRIPTION OF THE DRAWINGS

Further advantages are disclosed in the following description of the drawing. An exemplary embodiment of the invention is illustrated in the drawing. The drawing, the description and the claims contain numerous features in combination. The person skilled in the art will usefully also consider the features individually and in meaningful further combinations.

DETAILED DESCRIPTION OF EXEMPLARY EMBODIMENTS OF THE PRESENT INVENTION

Figure 1:
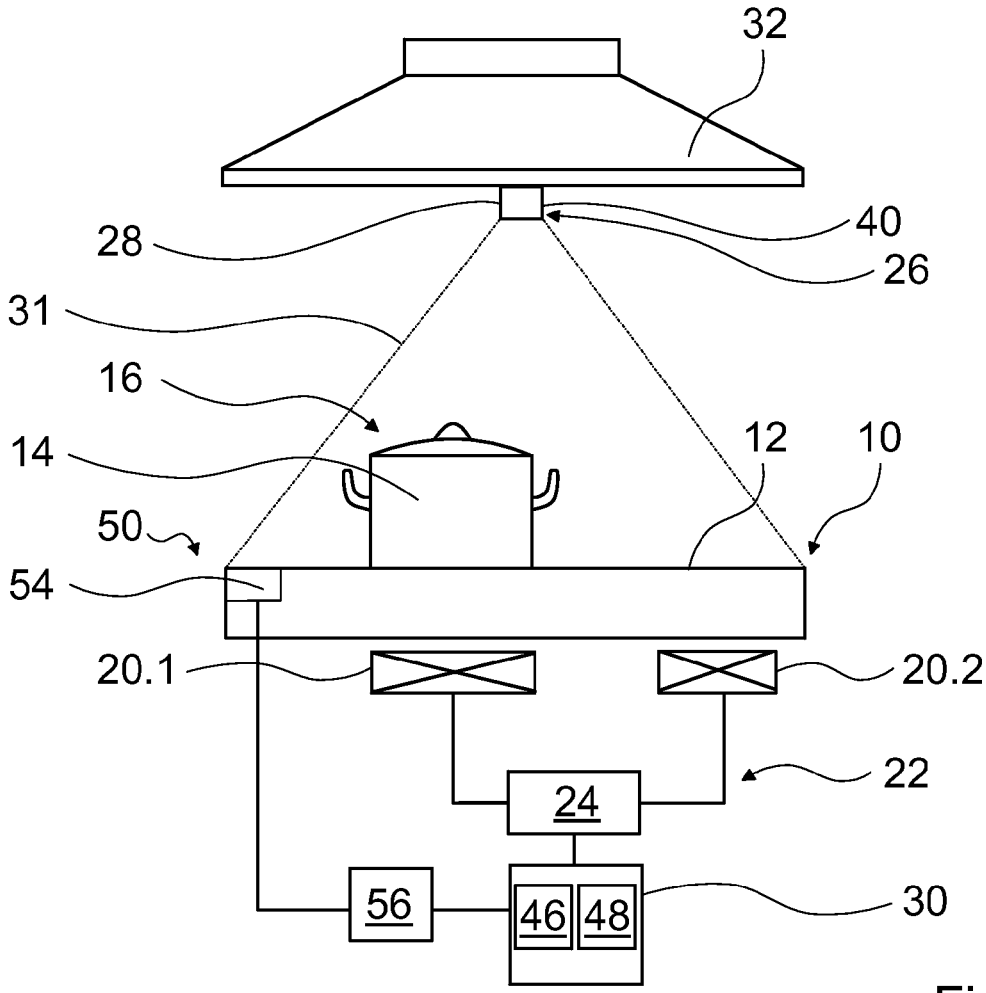
FIG. 1 shows a hob, a cooking vessel arranged in the cooking area of the hob, and internal units of the hob with a monitoring unit to monitor the cooking area.

FIG. 1 shows a hob 10 in a heavily schematized view. The hob 10 has a hotplate 12 which defines a cooking area 16 (also see FIG. 4) forming an arrangement for a cooking vessel 14. Here cooking area 16 means a three-dimensional area which is arranged above the hotplate 12 and is delimited below by the surface of the hotplate 12. The hob 10 is mounted in a kitchen countertop, not shown. In an alternate embodiment the hob 10 can be constructed as a component part of an electric cooker. The cooking area 16 has a plurality of cooking zones 18 (FIG. 4), each of which is assigned to a heating unit 20 arranged underneath the hotplate 12. The heating units 20 can have a heating resistor or an induction unit. As an alternate to division of the hotplate 12 into cooking zones 18 separate from each other, a version of the hob 10 is conceivable in which a cooking process for the cooking vessel 14 can be realized irrespective of the position of the cooking vessel 14, if for example a matrix arrangement of heating elements, in particular induction coils, forms a coherent cooking zone, which corresponds to the entire hotplate 12.

Figure 2:
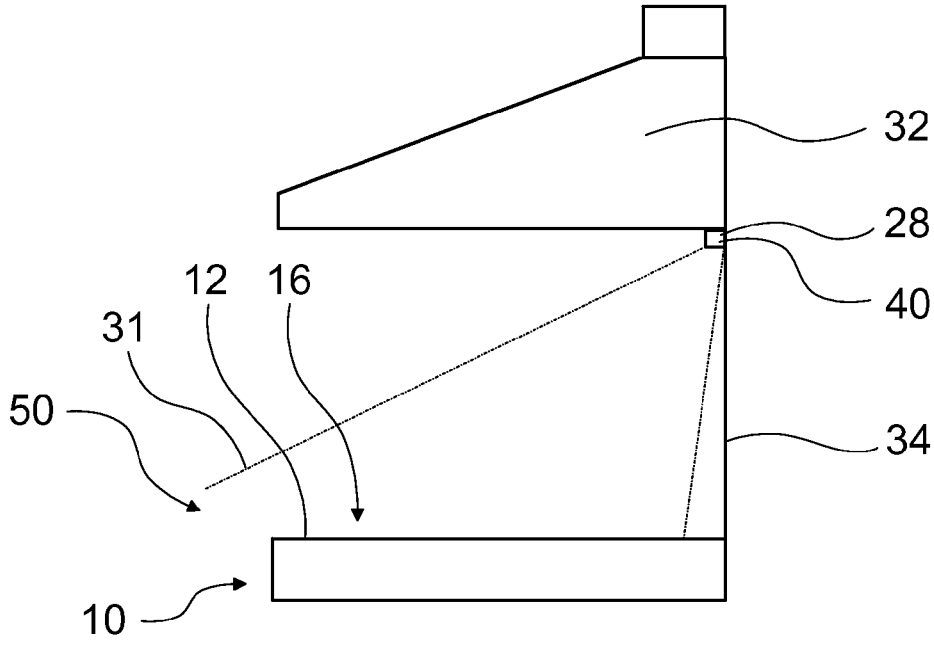
FIG. 2 shows a side view of the hob with a field of vision of the monitoring unit which extends beyond a front area of the hob.
Figure 3:
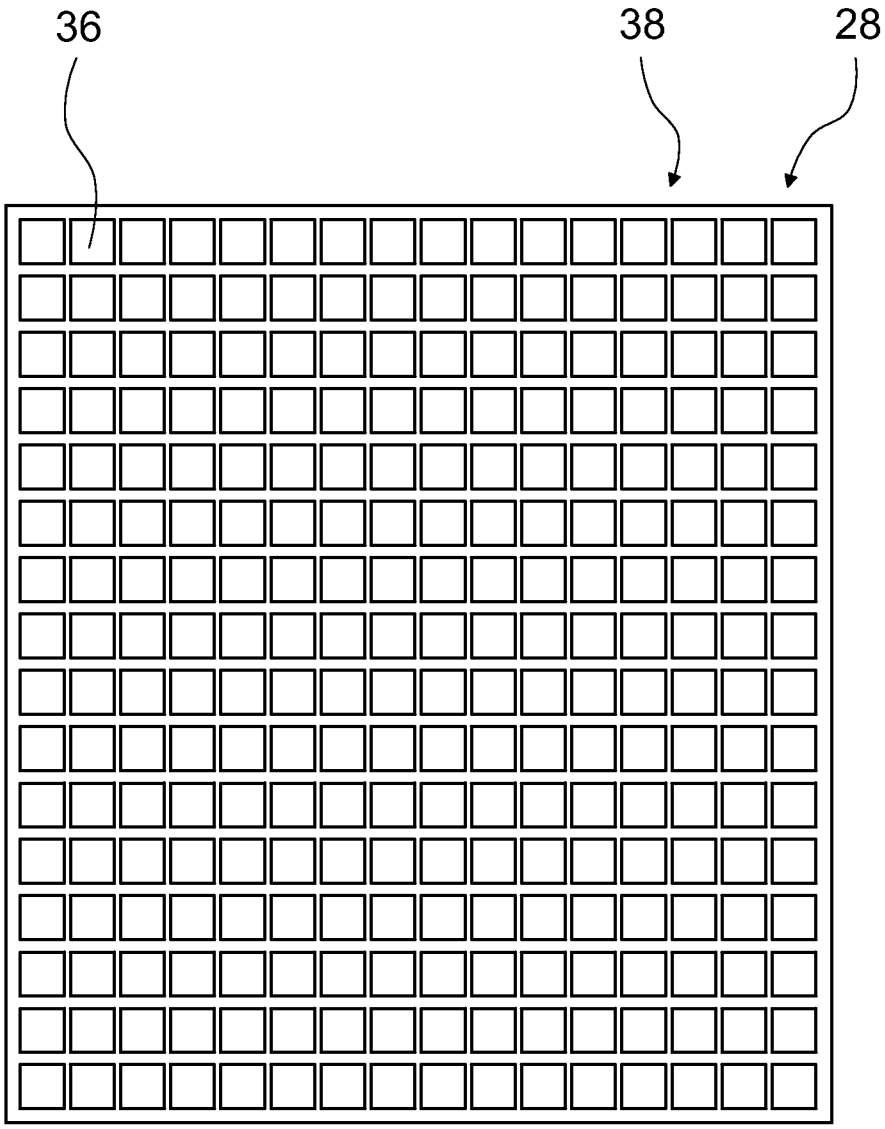
FIG. 3 shows a detailed view of a sensor unit of the monitoring unit, with an arrangement of infrared sensors.

The hob 10 has a hob device 22, which includes a control unit 24 which is provided for control of a heating operation in the cooking zones 18. For this, the control unit 24 acts in conjunction with the heating units 20. The control unit 24 has at least one arithmetic logic unit (not shown), which is constructed for example as a processor. The hob device 22 also has a monitoring unit 26 which is provided to monitor the cooking area 16. For this, the monitoring unit 26 includes a sensor unit 28 and an evaluation unit 30 which is provided for evaluation of data recorded by the sensor unit 28. The sensor unit 28 shown in further detail in FIG. 3 is arranged above the cooking area 16 and has a field of vision 31 which detects at least the cooking area 16 (see also FIG. 2), and is illustrated schematically in FIGS. 1 and 2 by means of dashed lines. In the embodiment shown, the sensor unit 28 is arranged above a rear area of the hob 10 and underneath an extractor hood 32. As FIG. 2 shows, the sensor unit 28 can be arranged, in particular, in a corner region formed by a wall 34 and the extractor hood 32. An alternate arrangement of the sensor unit 28 in a position which facilitates the detection of the cooking area 16, in particular the entire cooking area 16, is conceivable. In particular, it is possible to arrange the sensor unit 28 in the extractor hood 32. Data communication between the sensor unit 28 and the evaluation unit 30 can be effected by means of cabling, not shown, and/or a wireless connection.

FIG. 3 shows a detailed view of the sensor unit 28, which has an arrangement of a plurality of infrared sensors 36 denoted as a sensor array 38. The sensor array 38 is constructed as a two-dimensional array, it being possible for an unambiguous pair, comprising a line number and a column number, to be assigned to each infrared sensor 36. In particular, the sensor array 38 corresponds to a matrix arrangement with a square matrix of sixteen by sixteen infrared sensors 36. A further matrix arrangement with at least thirty two by thirty two infrared sensors 36 is conceivable. The sensor unit 28 is designed for detection in the infrared region. In particular, the infrared sensors 36 have thermocouples which form a thermopile or thermoelectric pile, for example. Further sensors which appear meaningful to the person skilled in the art for detection in the infrared region are conceivable. The sensor array 38 is arranged in a housing 40 of the sensor unit 28 (see FIGS. 1 and 2), said housing being a TO-5 type case, for example.

Figure 4:
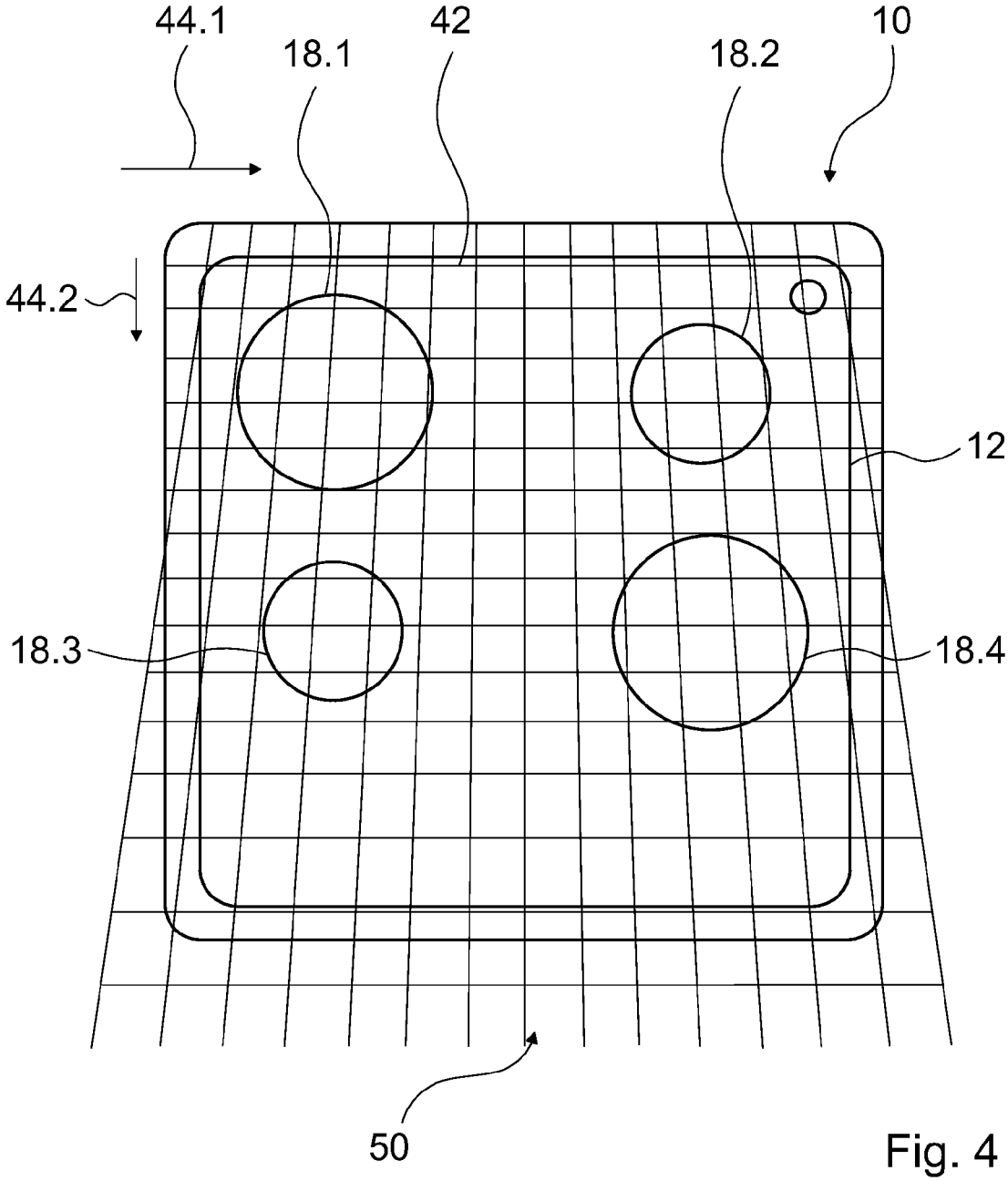
FIG. 4 shows a plan view of a hotplate of the hob from above and a rasterization of the cooking area produced by the sensor arrangement of FIG. 3.

As can be seen from FIG. 4, the sensor array 38 of FIG. 3 produces rasterization of the cooking area 16, it being possible for a grid 42 to be assigned to each infrared sensor 36 of the sensor array 38. The cooking area 16 has two directions of extension 44.1, 44.2 perpendicular to one another, which are aligned parallel to the sides of the hotplate 12. Because the sensor array 38 is constructed as a square matrix arrangement, sixteen grids 42 are assigned to each direction of extension 44. As can be seen from FIG. 4, the field of vision 31 of the sensor array 38 extends into the location area 50 in front of the front area of the hob 10. For the sensor array 38 with a matrix arrangement of sixteen by sixteen infrared sensors 36 for a hob of 60 cm, one grid 42 has an average length of approximately 4 cm, whereby small objects can be resolved in the cooking area 16.

Imaging of the monitored cooking area 16 can be obtained by means of the sensor array 38 of infrared sensors 36 when the monitoring unit 26 is operating. In order to utilize this advantageous application of the sensor array 38, the evaluation unit 30 is provided for image evaluation of data acquired by the sensor unit 28. For this, the evaluation unit 30 has an arithmetic logic unit 46 constructed as a microprocessor, and a memory unit 48 in which at least one program is stored for at least one image evaluation of data from the sensor unit 28. In particular, image processing software can be stored in the memory unit 48.

The principle of operation of the monitoring unit 26 with the sensor unit 28 and the evaluation unit 30, and their interaction with the control unit 24 is explained in detail with the aid of an example in FIGS. 5*a*, 5*b*, 6*a* and 6*b*.

Figure 5A:
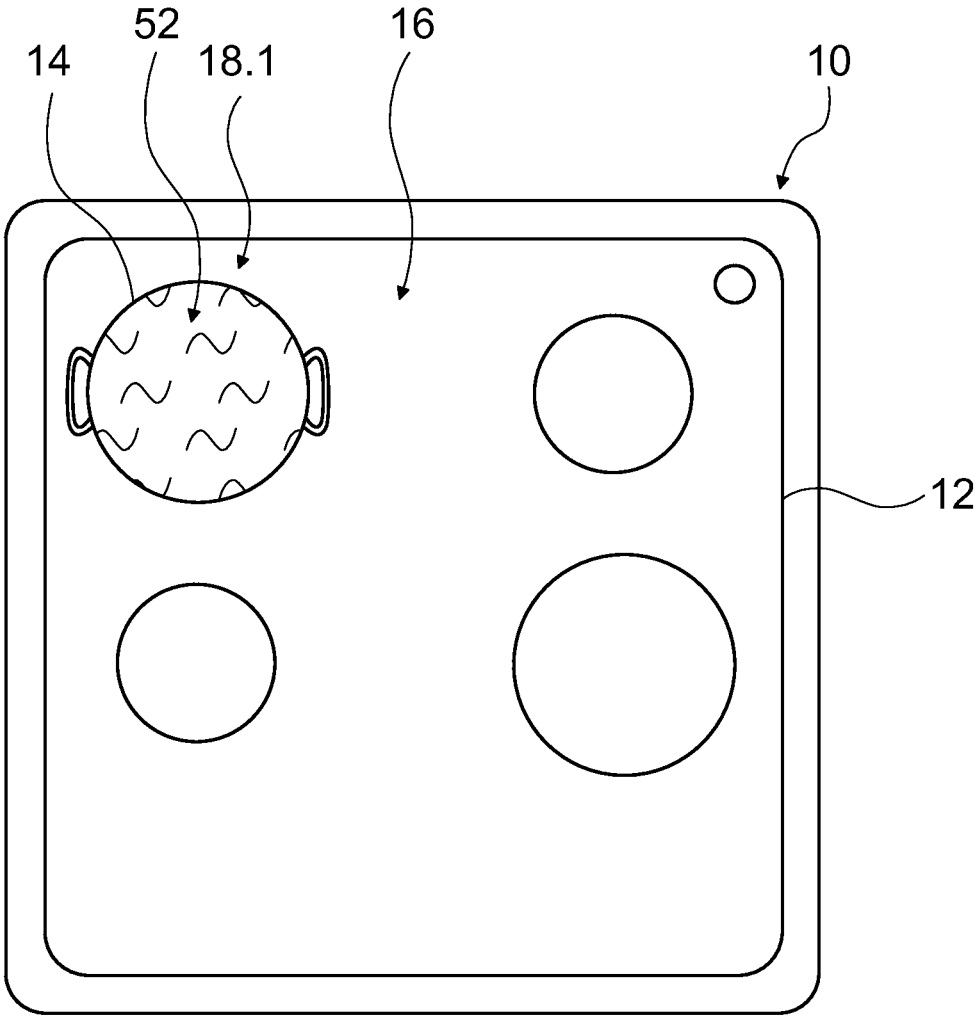
FIG. 5*a* shows a first application situation in which a liquid is being heated up in the cooking vessel.

It is assumed in accordance with the illustration in FIG. 5*a* that an operator of the hob 10 places the cooking vessel 14 in one of the cooking zones 18, that is to say in cooking zone 18.1. A liquid, that is to say a specified quantity of milk, is to be heated up in the cooking vessel 14. It is also assumed that after switching on the corresponding heating unit 20, the operator leaves the room in which the hob 10 is located, so that the continuous heating operation of the hob 10 is left unsupervised.

The absence of an operator in a location area 50 in which the operator of the hob 10 is located under the usual operating conditions, can be established by means of the evaluation unit 30 in combination with the sensor unit 28 by recording images acquired by the sensor unit 28 and subsequent evaluation of these image data. For this, the field of vision 31 of the sensor unit 28 extends into the location area 50, as can be seen in FIG. 2. In an alternate embodiment of the monitoring unit 26, the sensor unit 28 can detect only the cooking area 16, it being possible to provide a further sensor unit which is specially designed to monitor the location area 50. This sensor unit can be arranged in particular in the front area of the extractor fan 32.

Figure 5B:
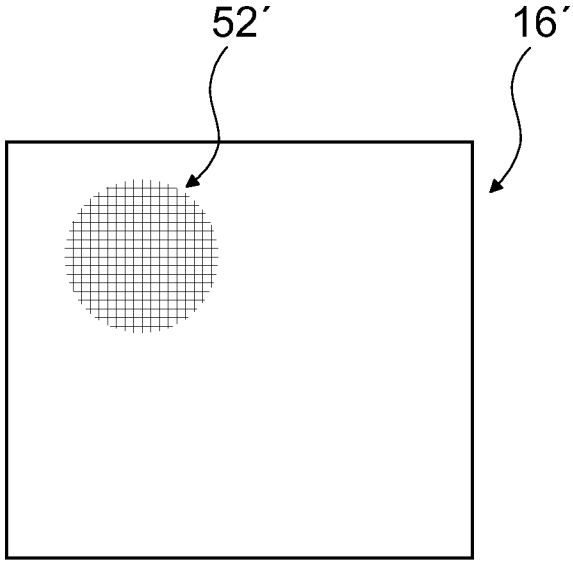
FIG. 5*b* shows an image recorded by the sensor unit of the cooking area in the application situation of FIG. 5*a*.

If the operator is located in the location area 50 in front of the hob 10, this is detected by the evaluation unit 30 in an image recording of the sensor unit 28 by means of the heat radiated by the human body. If, in the image captured by the sensor unit 28, there is no area indicating the presence of the operator in the location area 50, then the absence of the operator is detected by the evaluation unit 30. After this application situation has been determined by the evaluation unit 30, a monitoring mode of the monitoring unit 26 in which the current heating operation is continued under the supervision of the monitoring unit 26 is switched on. In this operating mode, a partial area of the cooking area 16 in particular is monitored and is recognized by the evaluation unit 30 as a hot area of the cooking area 16. In the present example a hot area 52 is formed by the surface of the food to be cooked. Due to the shape of the cooking vessel 14 this hot area 52 has a regular form, which in the present case corresponds to a circular shape. If a cooking vessel with a lid is used for the cooking process, then a hot area corresponds to the surface of the lid. FIG. 5*b* shows in schematic form an image 16' of the monitored cooking area 16 recorded by the sensor unit 28, and in which the hot area 52 can be seen in the form of an image 52'. Current images 16' of the monitored cooking area 16 are recorded when the monitoring mode is implemented. As a result, due to the interaction of the sensor unit 28 and the evaluation unit 30, a chronological sequence of images 16' of the cooking area 16 is captured and evaluated. In this chronological sequence of images 16', the contour of the hot area 52 in particular is monitored by the evaluation unit 30, for example by means of contour extraction and analysis of the contour obtained.

Figure 6A:
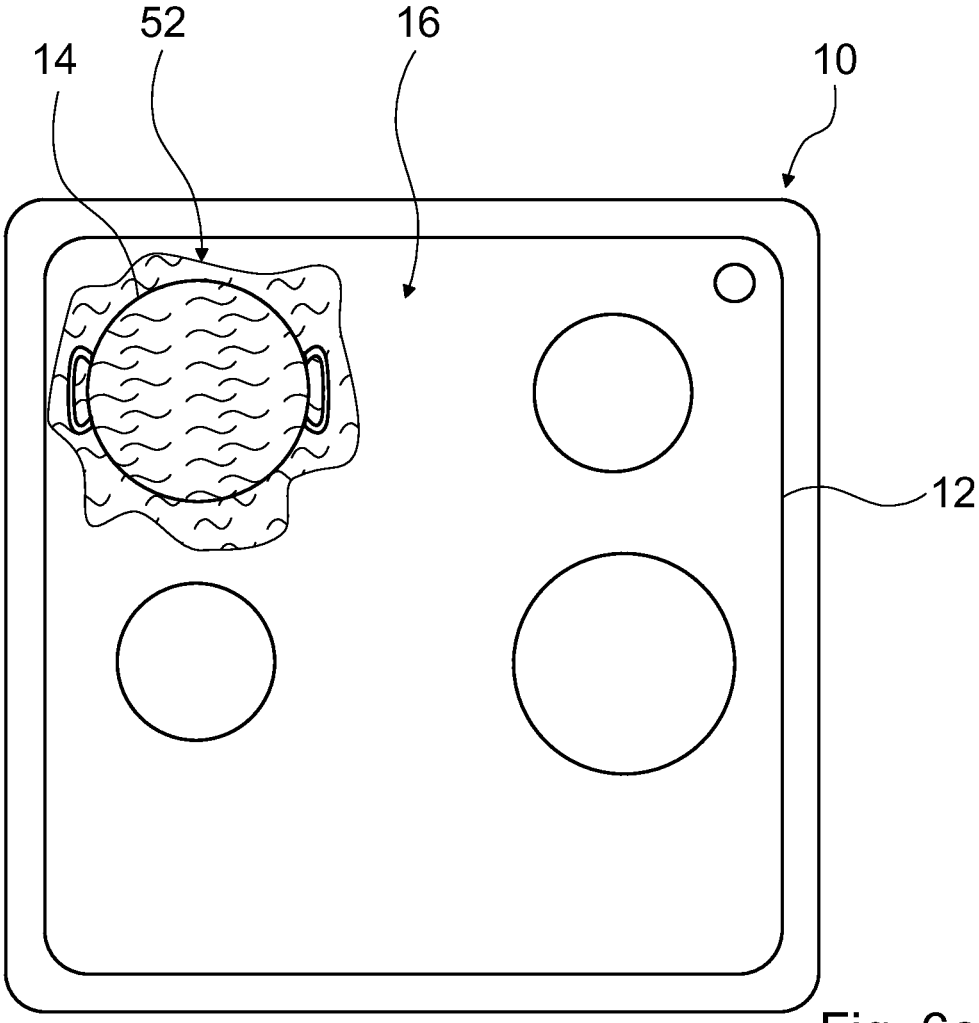
FIG. 6*a* shows a second application situation in which the liquid has overflowed out of the cooking vessel.
Figure 6B:
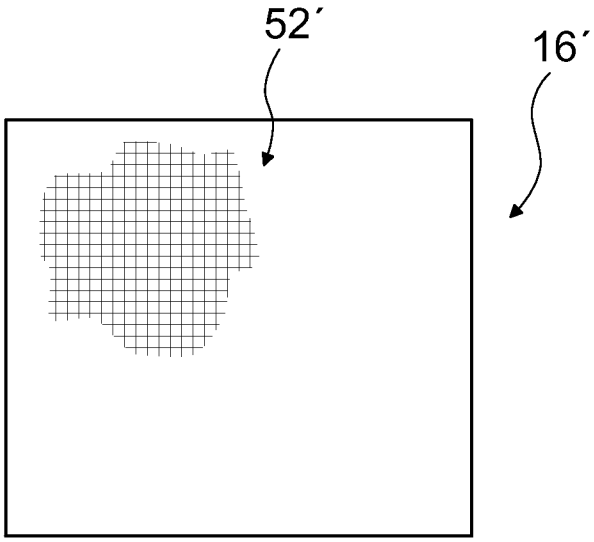
FIG. 6*b* shows an image recorded by the sensor unit of the cooking area in the application situation of FIG. 6*a*.

The evaluation unit 30 is provided to assign a specific application situation, in particular a hazardous situation, to a change of contour obtained in the chronological sequence of images 16'. Consequently, said evaluation unit can distinguish between normal heating-up of food to be cooked, corresponding to the illustration in FIG. 5*a*, and an application situation that is not intended by the operator. In particular, by means of image analysis of the data acquired by the sensor unit 28, a hazardous situation can be detected in which the food to be heated up is arranged outside of the cooking vessel 14 provided to heat it up, as in the application situation shown in FIG. 6*a*, for example. It is assumed from the illustration of FIG. 6*a* that in the absence of the operator the heated milk comes out of the cooking vessel 14 and spreads itself around the cooking vessel 14 on the hob 12. This is detected by the evaluation unit 30 in that the contour of the hot area 52 deviates from the regular, circular form of FIG. 5*a*. An image 16' of the cooking area 16 recorded by the sensor unit 28 is shown in FIG. 6*b*. The evaluation unit 30 recognizes this as an unintentional application situation, in particular a hazardous situation and transmits a signal to an output unit 54 of the monitoring unit 26, it being possible for an alarm signal to be output by the output unit 54. The output unit 54 can be constructed as an audible and/or a visual output unit 54. The monitoring unit 26 also includes a timer 56 which records the time elapsed since the onset of the unintentional application situation. If no operating procedure is actioned by the operator within a preset time interval, a signal is transmitted to the control unit 24, which switches off the corresponding heating unit 20. When the monitoring mode is enabled, the monitoring unit 26 has the function of a safety device for recognizing a hazardous situation and in this connection can, in particular, effect an emergency shutdown of at least one heating unit 20.

In a further application situation, instead of a complete shutdown of the heating unit 20, the heating power can be automatically reduced by the control unit 24. The development of steam and smoke can also be detected by a contour analysis of an image of a heating area of the monitored cooking area 16. For example, the development of vapor can be attributed to unintentional heating-up of oil, it being possible for an oil fire to be advantageously prevented through a shutdown process by means of the control unit 24.

Further variants of the monitoring mode of the monitoring unit 26 described above are conceivable. The monitoring mode described above can, for example, be implemented in the presence of the operator in the location area 50. This monitoring mode can be used advantageously as an aid for an inexperienced cook. In this connection, application situations detected by the evaluation unit 30 with the aid of images 16' of the cooking area 16 can be classified into at least three categories. Here a distinction can be made between normal heating-up of food to be cooked, a potentially unintentional application situation and an unintentional application situation which corresponds in particular to a hazardous situation. If an application situation is classified as potentially unintentional in the presence of the operator, then the operator can be requested by means of the output unit 54 to implement a confirmation process by which he confirms that the current heating operation is intentional. If this confirmation is implemented, then the heating operation is continued unchanged by the control unit 24. Means for classifying an application situation, in particular criteria which require specific conditions to be met, are stored in the memory unit 48 of the evaluation unit 30, it being possible for the classification to be implemented, for example, by comparing characteristic values obtained from image data from the sensor unit 28, with these pre-stored criteria.

The temperature characteristic at lids of a cooking vessel or at the surface of food to be cooked can also be monitored by image evaluation by means of the evaluation unit 30. If the temperature exceeds a certain value, this can be recognized as a potentially unintentional application situation or as a hazardous situation, whereby overcooking can be rapidly detected and prevented at least to some extent.

REFERENCE NUMBERS

10 Hob
12 Hotplate
14 Cooking vessel
16 Cooking area
16' Image
18 Cooking zone
20 Heating unit
22 Hob device
24 Control unit
26 Monitoring unit
28 Sensor unit
30 Evaluation unit
31 Field of vision
32 Extractor hood
34 Wall
36 Infrared sensor
38 Sensor array
40 Housing
42 Grid
44 Direction of extension
46 Arithmetic logic unit
48 Memory unit
50 Location area
52 Heating area
52' Image
54 Output unit
56 Timer

The invention claimed is:

1. A hob device, comprising:

a monitoring unit to monitor a cooking area of a hob, the monitoring unit having a sensor array of a plurality of infrared sensors to record infrared light for monitoring the cooking area of the hob, the sensor array being a one-dimensional in-line array of sensors or a two-dimensional array of sensors that provide an image of the cooking area, wherein each of the plurality of infrared sensors produces an electrical potential based on a temperature difference resulting from incident infrared light on each of the plurality of infrared sensors.

2. The hob device of claim 1, further comprising an evaluator for image evaluation of data recorded by the sensor array.

3. The hob device of claim 1, wherein the sensor array is the two-dimensional array of sensors.

4. The hob device of claim 3, wherein the sensor array is a square matrix arrangement.

5. The hob device of claim 1, wherein the monitoring unit is a safety device to detect a hazardous situation during operation of the hob.

6. The hob device of claim 1, wherein each of the plurality of infrared sensors comprises a thermocouple.

7. The hob device of claim 1, wherein the plurality of infrared sensors are arranged as one of thermopiles, thermocouple piles, and thermoelectric piles.

8. A hob device, comprising:

a monitoring unit to monitor a cooking area of a hob, the monitoring unit having a sensor array of a plurality of infrared sensors to record infrared light for monitoring the cooking area of the hob, wherein each of the plurality of infrared sensors produces an electrical potential based on a temperature difference resulting from incident infrared light on each of the plurality of infrared sensors; and an evaluator for image evaluation of data recorded by the sensor array, wherein the sensor array and the evaluator detect and evaluate a chronological sequence of images of the cooking area so as to recognize an application situation during operation of the hob.

9. The hob device of claim 8, wherein the evaluator assigns the application situation to a change in a respective contour that is determined in two different images.

10. A hob device, comprising:

a monitoring unit to monitor a cooking area of a hob, the monitoring unit having a sensor array of a plurality of infrared sensors to record infrared light for monitoring the cooking area of the hob, wherein each of the plurality of infrared sensors produces an electrical potential based on a temperature difference resulting from incident infrared light on each of the plurality of infrared sensors, and wherein an arrangement of the plurality of infrared sensors in the sensor array effects a rasterization of the monitored cooking area, and wherein eight grids are assigned to an extension direction of the monitored cooking area.

11. The hob device of claim 10, wherein sixteen grids are assigned to the monitored cooking area.

12. A hob device, comprising:

a monitoring unit to monitor a cooking area of a hob, the monitoring unit having a sensor array of a plurality of infrared sensors to record infrared light for monitoring the cooking area of the hob, wherein each of the plurality of infrared sensors produces an electrical potential based on a temperature difference resulting from incident infrared light on each of the plurality of infrared sensors, and wherein the sensor array has a field of vision that extends into a location area for a user of the hob when the user operates the hob, the location area being different from an area of the hob, the sensor array detecting one of a presence and an absence of the user in the location area.

13. A hob device, comprising:

a monitoring unit to monitor a cooking area of a hob, the monitoring unit having a sensor array of a plurality of infrared sensors to record infrared light for monitoring the cooking area of the hob, wherein each of the plurality of infrared sensors produces an electrical potential based on a temperature difference resulting from incident infrared light on each of the plurality of infrared sensors, wherein the monitoring unit is a safety device to detect a hazardous situation during operation of the hob, and wherein the monitoring unit has an evaluator to distinguish between normal heating-up of food to be cooked and an at least potentially unintentional application situation.

14. A hob device, comprising:

a monitoring unit to monitor a cooking area of a hob, the monitoring unit having a sensor array of a plurality of infrared sensors to record infrared light for monitoring the cooking area of the hob, wherein each of the plurality of infrared sensors produces an electrical potential based on a temperature difference resulting from incident infrared light on each of the plurality of infrared sensors, wherein the monitoring unit is a safety device to detect a hazardous situation during operation of the hob, and wherein the monitoring unit has an evaluator that detects a presence of food to be cooked that is outside of a cooking vessel provided to heat up the food to be cooked.

15. A hob, comprising:

a hob device that has a monitoring unit to monitor a cooking area of the hob, the monitoring unit having a sensor array of a plurality of infrared sensors to record infrared light, the sensor array being a one-dimensional in-line array of sensors or a two-dimensional array of sensors that provide an image of the cooking area, wherein each of the plurality of infrared sensors produces an electrical potential based on a temperature difference resulting from incident infrared light on each of the plurality of infrared sensors.

16. The hob of claim 15, wherein each of the plurality of infrared sensors comprises a thermocouple.

17. The hob of claim 15, wherein the plurality of infrared sensors are arranged as one of thermopiles, thermocouple piles, and thermoelectric piles.

18. A method, comprising:

monitoring a cooking area of a hob by means of a monitoring unit;

recording data from infrared sensors in a sensor array, the sensor array being a one-dimensional in-line array of sensors or a two-dimensional array of sensors that provide an image of the cooking area, wherein each of the infrared sensors produces an electrical potential based on a temperature difference resulting from incident infrared light on each of the infrared sensors; and evaluating the data to recognize an application situation.

19. The method of claim 18, wherein the data are evaluated by means of image evaluation.

20. The method of claim 18, wherein the infrared sensors comprise thermocouples.

21. The method of claim 18, wherein the infrared sensors are arranged as one of thermopiles, thermocouple piles, and thermoelectric piles.

* * * * *